United States Patent [19]

Gerhold et al.

[11] 4,297,842

[45] Nov. 3, 1981

[54] NOX SUPPRESSANT STATIONARY GAS TURBINE COMBUSTOR

[75] Inventors: Bruce W. Gerhold, Rexford; Colin Wilkes, Scotia, both of N.Y.

[73] Assignee: General Electric Company, Schenectady, N.Y.

[21] Appl. No.: 113,638

[22] Filed: Jan. 21, 1980

[51] Int. Cl.[3] ..... F02C 3/30; F23R 3/54

[52] U.S. Cl. ..... 60/39.06; 60/39.55; 60/759; 60/760

[58] Field of Search ..... 60/759, 760, 728, 39.55, 60/39.06; 431/4

[56] References Cited

U.S. PATENT DOCUMENTS

| | | | |
|---|---|---|---|
| 3,731,484 | 5/1973 | Jackson et al. | 60/759 |
| 3,738,106 | 6/1973 | Stein et al. | 60/760 |
| 4,044,549 | 8/1977 | Zwick | 60/39.55 |

*Primary Examiner*—Robert E. Garrett

*Attorney, Agent, or Firm*—Jerome C. Squillaro

[57] ABSTRACT

The NOx emissions of a stationary gas turbine are reduced by concentrating a NOx suppressant in the reaction zone of the gas turbine combustor by dividing the flow of air to the reaction zone and the dilution zone of the combustor by means of an air flow splitter and by taking advantage of the radially stratified compressor flow. The air flow to the two zones is preferably separated by a common flow shield.

5 Claims, 2 Drawing Figures

NOX SUPPRESSANT STATIONARY GAS TURBINE COMBUSTOR

BACKGROUND OF THE INVENTION

The abatement of emissions, particularly the oxides of nitrogen (NOx) is gaining increasing attention and significant resources are being applied to the associated problems.

It has been found that NOx is formed in the combustors of stationary gas turbines through two NOx forming mechanisms. Thermal NOx is formed by reaction between the nitrogen and oxygen in the air initiated by the high flame temperature and fuel NOx, on the other hand, results from the oxidation of organic nitrogen compounds in the fuel.

Various governmental agencies have proposed or enacted codes for regulating the NOx emissions of stationary gas turbines. For example, the United States Environmental Protection Agency has proposed a code limiting NOx emissions to 75 ppm at 15% oxygen with an efficiency correction. In Southern California, the Los Angeles County Air Pollution Control District's Los Angeles County Rule 67 limits NOx emissions to 140 lbs. per hour.

It has been found that the NOx emissions of a stationary gas turbine can be regulated by the addition of a suitable NOx suppressant fluid to the air supply of the gas turbine combustor. One example involves the recirculation of exhaust gases from a gas turbine-steam turbine combined power plant and is described in more detail in copending application Ser. No. 113,635, filed Jan. 21, 1980 of common assignee as the instant invention, the disclosure of which is hereby incorporated by reference. Another example involves the supply of an oxygen-deficient air mixture which is the by-product of an oxygen separation unit in a coal gasification plant, the oxygen being used together with coal to generate a medium BTU coal gas which is employed as the fuel for the stationary gas turbine combustor. The latter arrangement is described in more detail in copending application Ser. No. 113,637, filed Jan. 21, 1980 of common assignee as the instant invention, the disclosure of which is hereby incorporated by reference. Examples of other useful NOx suppressants in addition to the above are nitrogen, carbon dioxide and other high specific heat gases which are relatively inert.

When NOx suppressants are used, they are generally added to the air supply for the stationary gas turbine compressor. However, commercial gas turbines use a portion (15% or more) of the compressor discharge air for nozzle and turbine cooling. Since these air flows do not effect NOx emissions, adding the NOx suppressants to these flows represents a waste of the suppressant. Additionally, a minimum suppressant flow rate is desirable and concentrating a fixed amount of suppressant in only the combustor air or preferably in the primary reaction zone will produce better NOx control.

Figure 1:
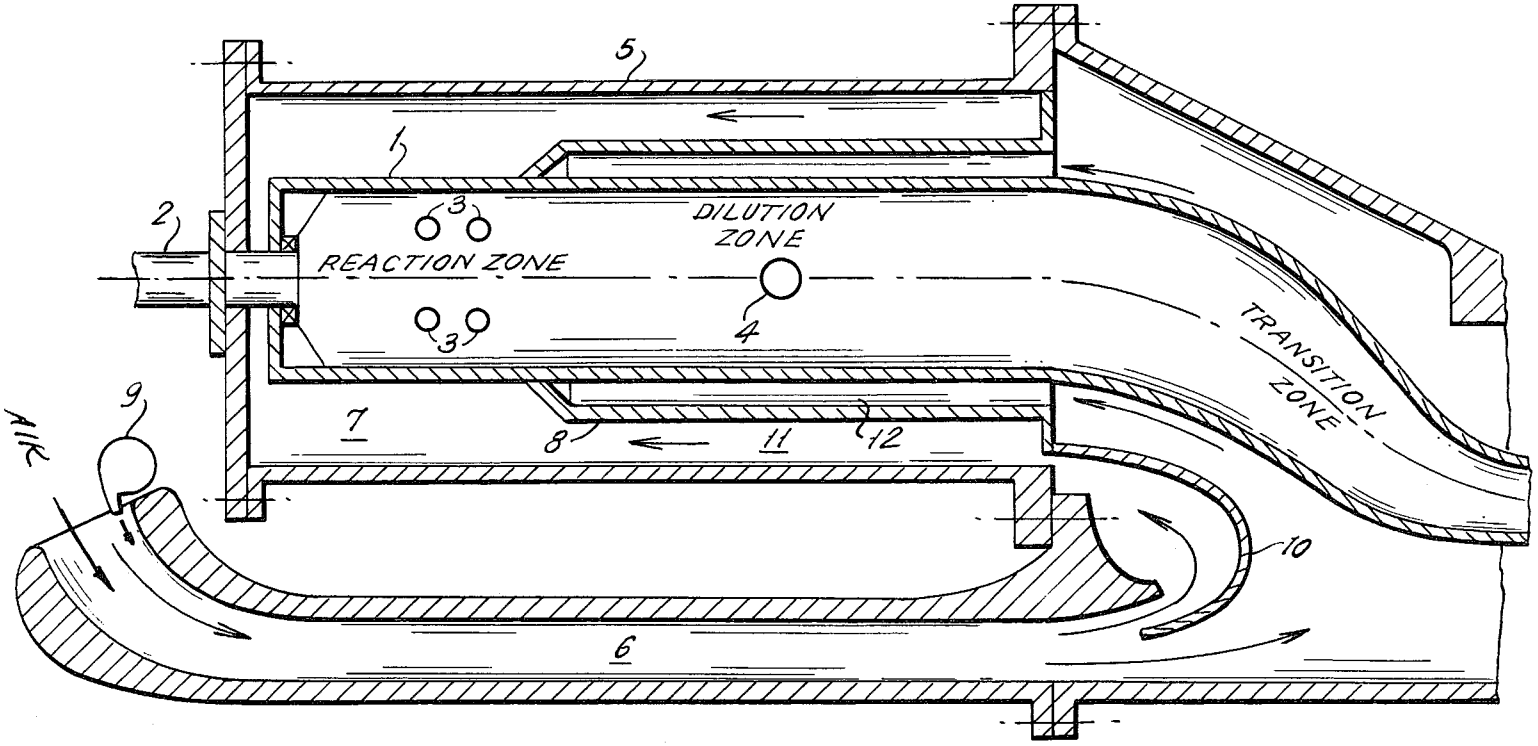
Figure 2:
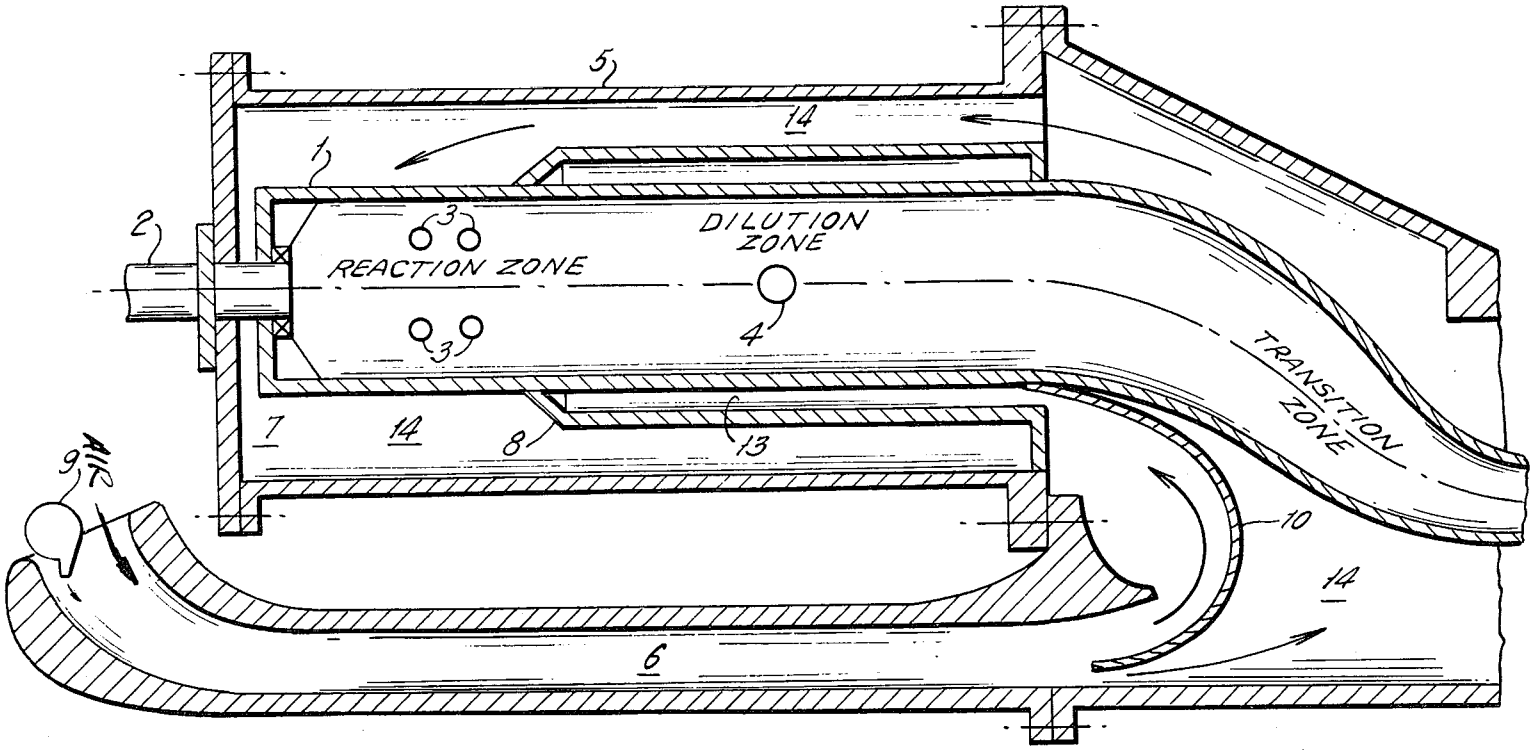

It is accordingly the object of this invention to provide a method and a means for concentrating NOx suppressants in the combustion air, which produces maximum NOx reduction, while minimizing the addition of suppressants to the cooling air flows. This and other objects of the invention will become apparent to those skilled in the art from the following detailed description in which FIG. 1 is a schematic representation of a first embodiment of the present invention; and FIG. 2 is a schematic representation of a second embodiment of the present invention.

SUMMARY OF THE INVENTION

This invention relates to a NOx suppressant stationary gas turbine combustor and more particularly to such a combustor where an air flow splitter divides the flow of air to the reaction zone and the dilution zone of the combustor so that NOx suppressant can be concentrated in the reaction zone by injection at a suitable point to take advantage of the radially stratified compressor flow.

DESCRIPTION OF THE INVENTION

FIGS. 1 and 2 are schematic representations of a conventional reverse air flow stationary gas turbine combustor which has been modified to include the present invention. It should be noted that although the invention is described with respect to a reverse air flow combustor, other combustor configurations may obviously be used without departing from the spirit and scope of the present invention.

The conventional stationary gas turbine combustor contains a combustion liner 1 which encloses, in the direction of flow, a reaction zone, a dilution zone and a transition zone leading to the gas turbine. A fuel nozzle 2, usually axisymmetrically disposed, introduces a suitable gaseous or liquid fuel through liner 1 into the reaction zone. Suitable means for introducing combustion air through liner 1 into the reaction zone, such as air entry ports 3 and suitable means for introducing a supply of air for dilution into the dilution zone, such as air entry port 4, are provided. Combustion liner 1 is encased within an outer casing 5. An air channel 6 carries compressed air from the stationary gas turbine air compressor to the combustor and communicates with the channel 7 formed between outer casing 5 and combustion liner 1. It is conventional to arrange the connection of air channel 6 with channel 7 such that the flow of fluids within channel 7, i.e., between outer casing 5 and combustion liner 1, is opposite the flow of fluids within combustion liner 1 to provide for surface cooling of liner 1.

In accordance with the present invention, provision is made for splitting the flow of air between the air which is intended to be utilized within the reaction zone for combustion purposes and the remainder of the air which is destined for use as a diluent in the dilution zone or for surface-cooling the dilution zone and possibly the transition zone. This is accomplished by imposing an annular flow shield 8 within the channel 7 defined by combustion liner 1 and outer casing 5. At one end of its longitudinal length, flow shield 8 joins combustion liner 1 at about the dividing point between the reaction zone and dilution zone. The other end of flow shield 8 usually extends to near the junction of channels 6 and 7.

The flow in a gas turbine axial compressor is predominantly in the axial direction and therefore a radially stratified inlet flow remains segregated at the compressor exit. By selecting the proper location at the compressor inlet or downstream of the compressor for injecting NOx suppressants, the suppressants can be concentrated in the combustion air which thereby maximizes NOx reduction. Thus, injecting NOx suppressant in discrete locations at the compressor inlet provides lower NOx emissions than homogeneously mixing the flows upstream of the compressor inlet. The turbine cooling flow rates are not altered and they do not contain significant amounts of NOx suppressant. The injection of the NOx suppressant is represented in FIGS. 1 and 2 by suppressor injector 9.

The flow of air in air flow channel 6 is preferably longitudinally along the channel 6 with little transverse component and is divided into two paths by air flow splitter 10 which is preferably in the form of an aerodynamically curved baffle shield or scoop. By appropriate construction of flow shield 8 and air flow splitter 10, the flow of air in channel 7 adjacent the transition zone is either in common with the flow of air adjacent the dilution zone or the reaction zone while the air flows to the latter two zones remain segregated.

In FIG. 1, the flow of air to the reaction zone is isolated from both the flow of air to the dilution zone and adjacent transition zone. Thus, in this embodiment air flow splitter 10 is connected to flow shield 8. The flow of air to the reaction zone is through the path 11 defined by air flow splitter 10, flow shield 8, outer casing 5 and that portion of combustion liner 1 which is adjacent the reaction zone. The path 12 for the flow of air to the dilution zone is defined by air flow splitter 10, flow shield 8, outer casing 5 and that portion of combustion liner 1 which is adjacent to both the dilution zone and the transition zone. In FIG. 1, the positioning of suppressant injector 9 represents the injection of the NOx suppressant at the tips of the blades of the air compressor. As a result of such positioning and the radially stratified compressor air flow, there will be substantially parallel flows in channel 6 with most of the NOx suppressant entering path 11 leading to the reaction zone.

In FIG. 2, the dilution zone is isolated from the reaction zone and the transition zone. This is effected by connecting the aerodynamically curved baffle shield 10 to combustion liner 1 instead of the flow shield 8 as in FIG. 1. Thus, in FIG. 2 the path 13 to the dilution zone is defined by air splitter 10, flow shield 8 and that portion of combustion liner 1 adjacent the dilution zone. The air flow path 14 to the reaction zone is defined by that portion of combustion liner 1 adjacent the reaction zone and the transition piece, flow shield 8, outer casing 5 and air splitter 10. The positioning of suppressant injector 9 in FIG. 2 represents the injection of the NOx suppressant at the roots of the inlet blades of the air compressor for the gas turbine and as a result of the radially stratified compressor air flow, the NOx suppressant will be concentrated in the air flow to the reaction zone.

Based on data collected in connection with NOx reduction by the injection of an oxygen-deficient air mixture as described in the above referenced application Ser. No. 113,637, it has been determined that when the oxygen-deficient air mixture is mixed homogeneously with the combustion and cooling air flows, about a 55% reduction of NOx can be realized. By operating in accordance with the present invention, that is, by introducing the oxygen-deficient air mixture through NOx suppressant injection ports in the combustion air to concentrate the mixture, an estimated 63% reduction can be achieved. Since the easy methods of NOx reduction have already been identified and commercially adopted and the additional increments in NOx reduction are extremely difficult to achieve, the additional NOx reduction realized with the present invention represents a significant advance and can mean the difference between complying and not complying with proposed governmental regulations concerning emissions.

In practicing the present invention in the embodiments illustrated in FIGS. 1 or 2, the NOx suppressant is concentrated in the combustion flame zone and the 55% NOx reduction could be achieved using only about 30% of the NOx suppressant flow required above. Alternately, using the same NOx suppressant flow rate, larger NOx reductions are possible, but the total reduction will ultimately be limited by flame stability criteria.

Various changes and modifications can be made in the present invention without departing from the spirit and scope thereof. For example, in conventional multi-combustor arrays, each combustor can be provided with an air splitter or a common air splitter/manifold arrangement can be used. The various embodiments which have been disclosed herein were for the purpose of further illustrating the invention but were not intended to limit it.

What is claimed is:

1. In a stationary gas turbine combustor comprising a reaction zone, a dilution zone, a combustion liner enclosing said reaction and dilution zones, means to introduce air into said reaction zone through said liner, means to introduce air into said dilution zone through said liner, a fuel nozzle for introducing fuel into said reaction zone through said liner and air flow means for conveying air from an air compressor to said means for introducing air into said reaction zone and said means to introduce air into said dilution zone, the improvement comprising an air flow splitter disposed within said air flow means for dividing the flow of air into a first path communicating with said means to introduce air into said reaction zone and a second path communicating with said means to introduce air into said dilution zone and, means for injecting NOx suppressants into said air flow means, said injecting means disposed adjacent said air compressor and relative to said air flow means to concentrate said NOx suppressants in said first path by utilizing the radially stratified compressor air flow.

2. The combustor of claim 1 wherein said first and second paths are isolated from one another by a flow shield disposed within said air flow means and wherein said flow shield is connected to said combustion liner at a point between said reaction and dilution zones.

3. The combustor of claim 2 including an outer casing enclosing said combustion liner and wherein said air flow means includes a channel formed between said combustion liner and said outer casing.

4. In a method of operating a stationary gas turbine combustor comprising a reaction zone, a dilution zone, a combustion liner enclosing said reaction zone and dilution zone, means to introduce air into said reaction zone through said liner, means to introduce air into said dilution zone through said liner, a fuel nozzle for introducing fuel into said reaction zone through said liner and an outer casing enclosing said combustion liner by introducing fuel into said reaction zone through said fuel nozzle and introducing air from the air compressor of said gas turbine into an air flow channel at least partially defined between said outer casing and said combustion liner and thereby into said reaction zone and dilution zone through said means to introduce air into said reaction zone and said means to introduce air into said dilution zone, the improvement which comprises dividing the flow of air into said air flow channel into a first path communicating with said means to introduce air into said reaction zone and a second path communicating with said means to introduce air into said dilution zone and introducing a NOx suppressant fluid in the flow of air in said air flow channel adjacent said air compressor to concentrate said NOx suppressant fluid in said first path by utilizing the radially stratified compressor air flow.

5. The method of claim 4 wherein said air flow is divided by means of an air flow splitter and said NOx suppressant fluid is introduced by injecting said fluid into the flow of air upstream of said air flow splitter and conveyed into the first path by means of said radially stratified compressor air flow.

* * * * *